US005209410A

United States Patent [19]

Wichmann et al.

[11] Patent Number: 5,209,410

[45] Date of Patent: May 11, 1993

[54] ELECTROSTATIC DISPENSING NOZZLE ASSEMBLY

[75] Inventors: Frederick R. Wichmann, Cincinnati; Donald R. Henry, Middletown, both of Ohio

[73] Assignee: United Air Specialists, Inc., Cincinnati, Ohio

[21] Appl. No.: 846,599

[22] Filed: Mar. 5, 1992

[51] Int. Cl.[5] ..... B05B 5/02

[52] U.S. Cl. ..... 239/696; 239/562; 239/568

[58] Field of Search ..... 239/690, 708, 690.1, 239/597, 562, 568, 696, 308

[56] References Cited

U.S. PATENT DOCUMENTS

| | | | |
|---|---|---|---|
| 2,685,536 | 8/1954 | Starkey | 239/562 X |
| 2,706,964 | 4/1955 | Ransburg et al. | 239/708 X |
| 3,508,711 | 4/1970 | Switall | 239/562 |
| 3,615,054 | 10/1971 | Botz | 239/568 X |
| 4,749,125 | 6/1988 | Escallon et al. . | |
| 4,788,016 | 11/1988 | Colclough et al. | 239/690 X |
| 4,814,788 | 3/1989 | Davies | 239/690 X |
| 4,830,872 | 5/1989 | Grenfell | 239/690 X |

FOREIGN PATENT DOCUMENTS

| | | | |
|---|---|---|---|
| 269313 | 2/1966 | Australia | 239/597 |
| 2830316 | 1/1980 | Fed. Rep. of Germany | 239/562 |
| 1254944 | 11/1971 | United Kingdom | 239/568 |

OTHER PUBLICATIONS

*Iron and Steel Engineer*, "New electrostatic spraying technologies", Donald R. Henry and Eduardo C. Escallon, Nov. 1992, pp. 42–45.

*Primary Examiner*—Andres Kashnikow
*Assistant Examiner*—Kevin P. Weldon
*Attorney, Agent, or Firm*—Frost & Jacobs

[57] ABSTRACT

A nozzle assembly for electrostatically dispensing a flowable material at a controllable rate and in a reliable and uniform manner includes a housing with a dispensing edge and front and rear members joined together to provide a continuous dispensing slot along the dispensing edge. The nozzle is a unitary device having a plurality of substantially hydraulically independent chambers therewithin in fluid communication with the substantially continuous and uninterrupted dispensing slot, whereby flowable material can be selectively supplied to the individual chambers to control the width of material application without structurally modifying the nozzle itself. Field gates are provided at each end of the nozzle to further control the deposition of the charged material, and the nozzles can be oriented to dispense flowable material in substantially any orientation, including vertically upwardly.

31 Claims, 5 Drawing Sheets

ELECTROSTATIC DISPENSING NOZZLE ASSEMBLY

TECHNICAL FIELD

This invention relates to devices for electrostatically dispensing flowable liquids onto a predetermined target, and, more particularly to a nozzle assembly for reliably and uniformly dispensing flowable material over a predetermined area of a target in a controllable manner, wherein the nozzle features a relatively simple construction for efficient assembly, use and maintenance.

BACKGROUND ART

Applications in which a flowable material is to be relatively uniformly applied onto a predetermined area or surface are numerous, varied, and constantly growing. For example, steel products require a protective coating of rust prohibitive oil following the manufacturing process to protect the finished products during shipping, storage, processing and the like. Similarly, products such as galvanized steel, fabrics, food products, and other materials also often require application of a predetermined coating or treatment of liquid or other flowable material for a variety of reasons. While conventional spraying techniques, physical application, dipping, wiping, soaking and other procedures have been implemented with varying degrees of frequency and success, efficiency and reliability of quality and coverage is most often of paramount importance in modern application environments.

U.S. Pat. No. 4,749,125, which issued to Escallon et al., pertains to a method and apparatus for electrically charging and dispensing fluids and the like to allegedly overcome the problems of prior art dispensing orifices and mechanical means for dispensing fluids. Particularly, Escallon et al. describes the previous use of small dispensing orifices, mechanical means such as spinning disks, or aerodynamic means for finely dividing fluid into droplets. Such prior techniques and devices suffered from problems of clogging, non-uniformity of application, and inefficiency of energy use and application volume. This patent emphasizes the importance of controlling material droplet size and the overall uniformity of dispensing in most applications.

The Escallon et al. nozzle is described as including a fluid reservoir in a housing which defines a chamber having a resiliently compressible elongated slot at its tip. A shim is provided in the chamber slot, and the thickness of the shim and the compressing force on the chamber serve to define the size and shape of the slot for dispensing. The shim and the fluid are electrically connected to high voltage, which causes the fluid meniscus which forms at the slot to be dispensed from the nozzle as charged droplets. Escallon et al. contemplates voltages of between about 10 and 50 kilovolts for dispensing fluids in a viscosity range of between about 1 and 20,000 cps, and teaches that precision selection of the shim determines the flow characteristics of the dispensed fluid dependent on the fluid pressure within the chamber. This patent also teaches that the distal edge of the shim must have a discontinuous geometry to control the rate of flow through the nozzle.

It has been observed, however, that nozzles made in accordance with the teachings of Escallon et al. often encounter problems in providing an application spray of predetermined, uniform consistency for coating of material at a predetermined rate per volume of area. Particularly, there is a clear lack of ability to carefully control the volume of material coated on the target area, and a lack of control of the uniformity of such application. Additionally, in many applications where electrostatic dispensing is useful, the application equipment must be reliable and easy to clean and maintain. For example, in applications involving food or other edible products, the equipment must be maintainable in clean and healthful conditions to meet standards of quality under applicable food and health laws and the like. In manufacturing applications, it is often required to alternately change between flowable materials to be coated, and time required for such changeover is critical to productivity and profitability. Moreover, to obtain acceptable uniformity of material dispensing, material dispensing flow rates and uniformity of dispensing across the nozzle must be reliable and continuous. The prior art devices could not deliver these requirements.

It should also be noted that due to the relatively high voltage necessary to properly incorporate electrostatic deposition of flowable materials, adequate support of the high voltage components is critical. The voltage is constantly seeking the path of least resistance, and the device will be ineffective for dispensing procedures if such voltage finds an alternate path to ground. In addition to the problems discussed above, electrostatic dispensing nozzles available in the industry heretofore did not provide adequate support for the high voltage power, and were relatively unreliable and difficult to maintain on line as a result of the relatively complex support structures required to accommodate a plurality of nozzles arranged in series to provide a predetermined dispensing width.

Particularly, the nozzles suffered from leakage of flowable material and down-time caused by nozzle grounding and cleanup requirements. Such electrostatic dispensing nozzles were available in predetermined widths of about 6 inches (about 15.2 cm) and about 3 inches (about 7.6 cm), and application widths for particular coating procedures were obtained by side-by-side alignment of a plurality of such nozzles. The smaller nozzles were recently developed in response to overspray and underspray problems generally encountered when the width of the target to be coated was less than or greater than the width of the aligned nozzles. Additionally, at the interface of each adjacent nozzle, there was often a discontinuity in the application of the flowable material, causing corresponding discontinuities in the overall uniformity of material application.

Additional problems arose where electrostatic dispensing was required from below a product or target, wherein electrostatic dispensing nozzles were required to "shoot up" in order to coat a target from below. Particularly, in addition to the problems discussed above, nozzles available heretofore simply could not adequately overcome the additional problems imposed by gravity, and failed to reliably provide a uniform application of flowable material from below the target at a controlled application rate.

DISCLOSURE OF THE INVENTION

It is an object of this invention to obviate the above-described problems and shortcomings of electrostatic dispensing nozzles and devices heretofore available in the industry.

It is another object of the present invention to provide a nozzle assembly for electrostatically dispensing a flowable material onto a target in a controllable and uniform manner.

It is also an object of the present invention to provide a reliable nozzle assembly for electrostatically dispensing a flowable material onto a target at a predetermined application rate, wherein the nozzle assembly is relatively simple in construction and easy to operate and maintain.

It is yet another object of the present invention to provide an electrostatic nozzle assembly featuring a unitary dispensing nozzle featuring improved uniformity and control of material dispensing procedures, wherein a continuous, uniform coating of flowable material can be provided at a predetermined flow rate in a reliable and repeatable manner.

It is another object of the present invention to provide a nozzle assembly for electrostatically dispensing flowable material above and/or below a target at a predetermined controlled and uniform rate of application.

In accordance with one aspect of the present invention, there is provided an electrostatic nozzle assembly for dispensing flowable material onto a predetermined target in a controllable and uniform manner, including a housing having a dispensing edge with a predetermined longitudinal length, and front and rear members joined together to provide a substantially continuous slot adjacent the dispensing edge. A plurality of substantially hydraulically independent distribution chambers are arranged serially within the longitudinal length of the housing, with each of the chambers being placed in fluid communication with the slot. A conductive shim located at least partially within the chamber provides an electrical charge to the flowable material within the distribution chambers and adjacent the slot to cause the flowable material to be electrostatically dispensed from the nozzle assembly in use. Each chamber is independently attached to a source of the flowable material, wherein the material can be selectively supplied to individual distribution chambers to control the dispensing process along the longitudinal length of the nozzle slot as desired. In this way, the nozzle assembly can be quickly and automatically adjusted for varying widths of application without a need for physically changing or modifying the structure of the nozzle assembly.

In a preferred embodiment, the dispensing edge is substantially continuous and uninterrupted along the entire width of the slot. Particularly, it is preferred that each of the front and rear members of the housing of the nozzle assembly be provided as a unitary piece and joined together to provide the uninterrupted dispensing edge along which the dispensing slot is located. The distribution chambers preferably feature a delta shape which expands in width from adjacent a material inlet toward the dispensing edge. It is also preferred that the adjacent chambers be substantially hydraulically isolated from one another by the combination of a relatively continuous sealing member and barrier seals between the opposite lower portions of each chamber. Such seal effectively sandwiches the conductive shim between the front and rear members of the nozzle.

In a preferred embodiment, the opposite ends of the longitudinal length of the housing each include a field gate, wherein no fluid communication is provided with the source of flowable material, but wherein the conductive shim provides an electrical charge adjacent the dispensing edge of the nozzle.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
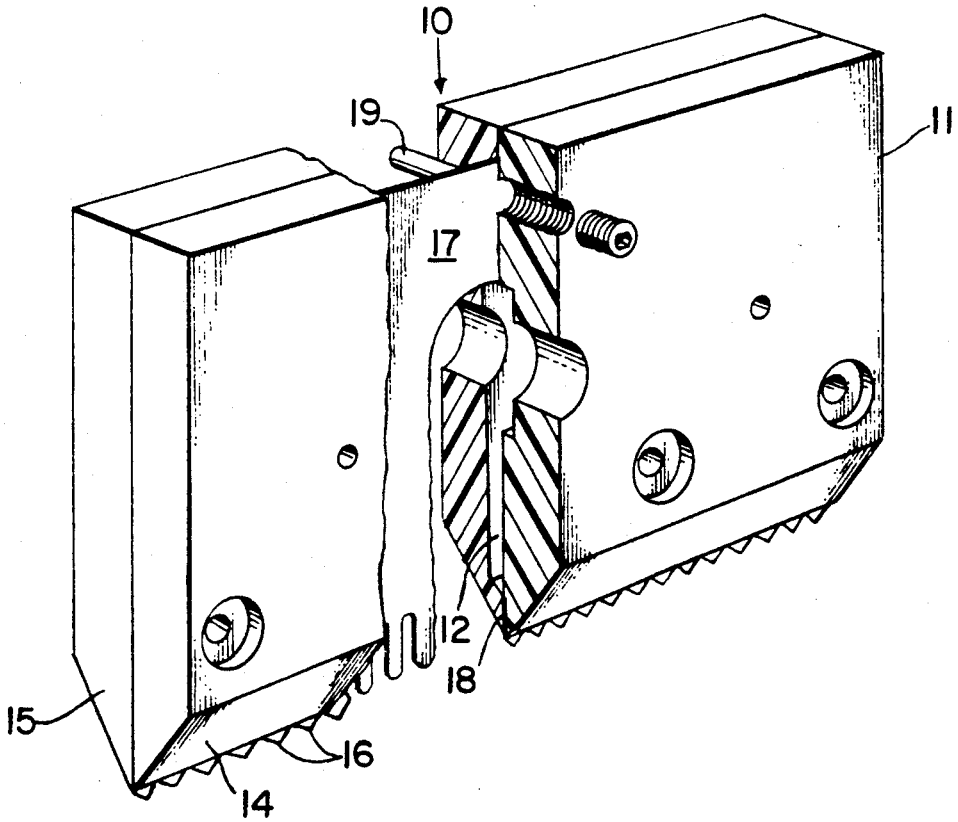
Fig. 1 PRIOR ART
FIG. 1 is a partially broken out, perspective view illustrating a prior art electrostatic dispensing nozzle.

Referring now to the drawings in detail, wherein like numerals indicate the same elements throughout the views, FIG. 1 illustrates a prior art asymmetrical dispensing nozzle 10 having a housing 11 with an interior cavity 12 for receiving flowable material and directing the same to lower slot 18 for dispensing. Nozzle 10 comprises a front lip 14 and a rear lip 15, and a conductive shim 17 having a discontinuous lower edge is sandwiched therebetween. The lower lip 15 also includes charge concentrating peaks 16 for allegedly forming a flow path for discharge of the material during operation of the nozzle.

Nozzles similar to that shown in FIG. 1 are shown and described in U.S. Pat. No. 4,749,125, wherein a high voltage terminal (e.g., 19 in FIG. 1) is provided to charge the flowable material for dispensing.

Figure 2:
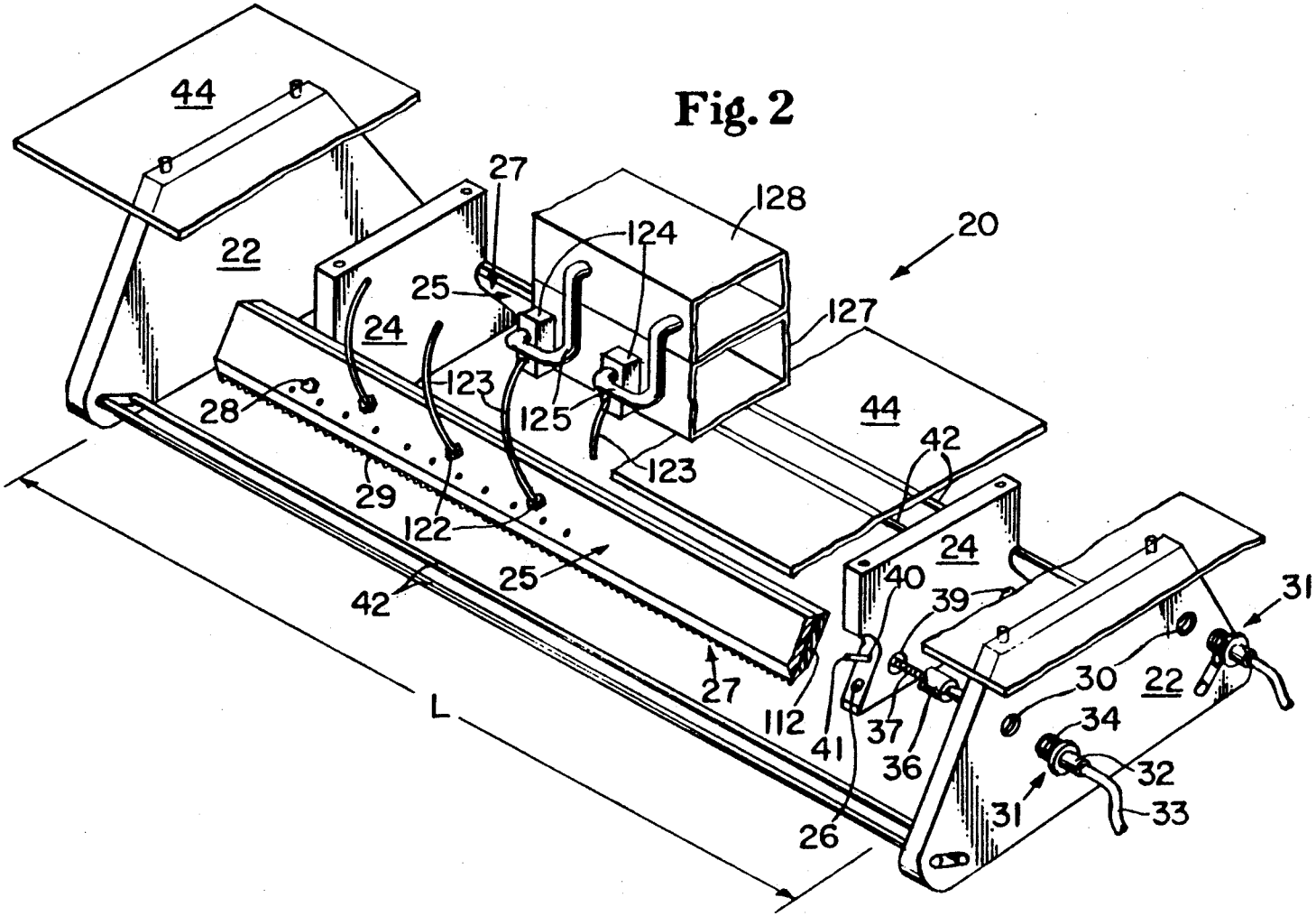
FIG. 2 is a partially broken out, perspective view of a portion of a nozzle assembly for electrostatically dispensing a flowable material made in accordance with present invention, and showing a pair of dispensing nozzles contemplated for dispensing in a generally downward direction.

An upper nozzle assembly 20, which can preferably comprise a portion of a preferred embodiment of the nozzle assembly of the present invention, is shown in FIG. 2 as comprising a pair of oppositely disposed end blocks 22 and a pair of oppositely disposed mounting blocks 24 supporting a pair of spaced and generally downwardly oriented zoned unitary nozzles 25. Nozzles 25 have an effective predetermined longitudinal length L, and each of the nozzles 25 further comprises a housing 27 and a longitudinally disposed dispensing edge 29 along a longitudinal length L.

One of the end blocks 22 further preferably comprises a pair of threaded holes (e.g., 30) to accept one or more high voltage inputs, as illustrated in FIG. 2 as high voltage feed-through assemblies 31. Particularly, each assembly 31 further comprises a male high voltage plug connector 32 attached to high voltage wire 33, which will, in turn, be attached to an appropriate source (not shown) of voltage.

Figure 4:
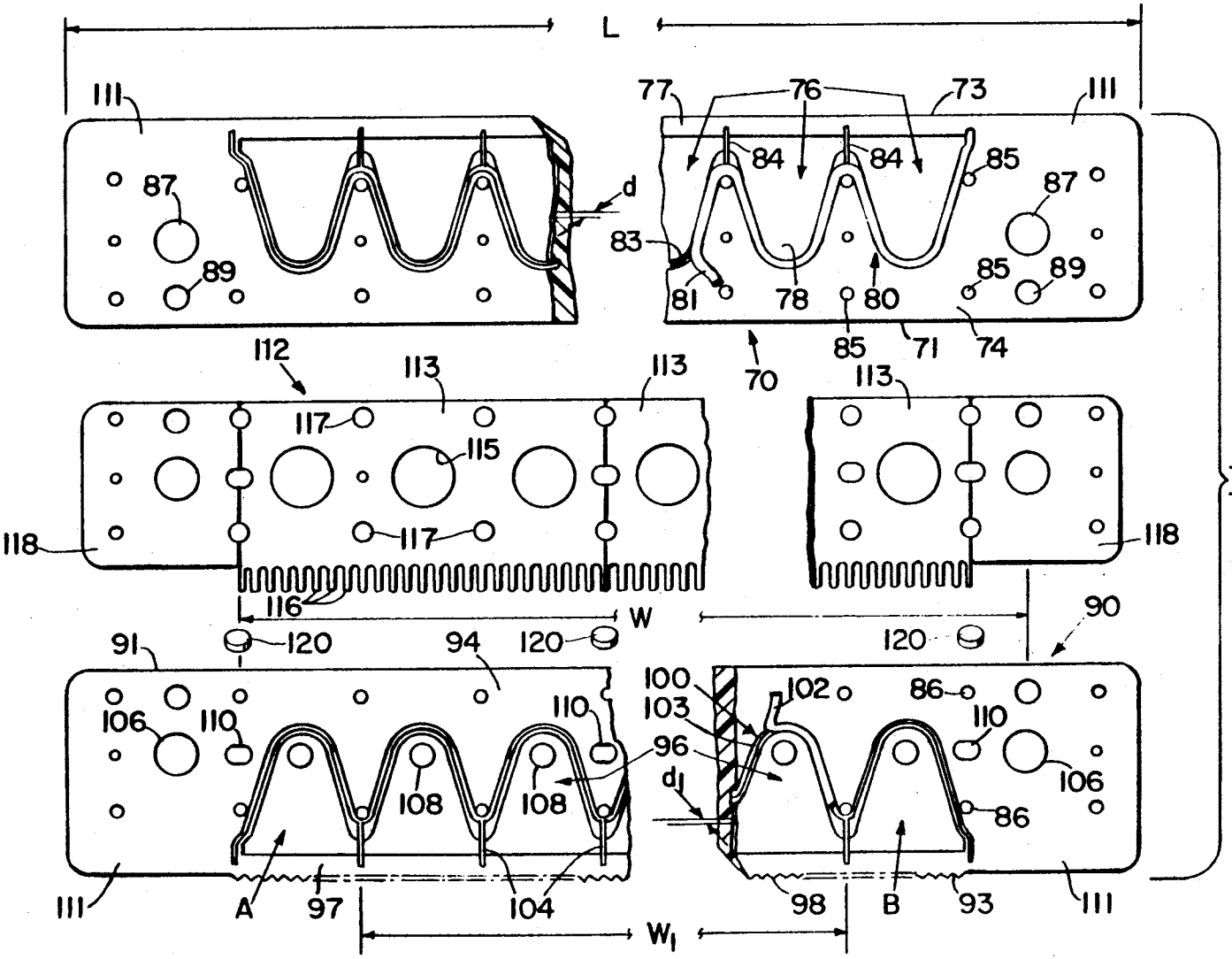
FIG. 4 is a partial, exploded view of an electrostatic dispensing nozzle made in accordance with the present invention.

Attachment conduit 34 is illustrated as having external threads which threadably interact with internally threaded hole 30. It is contemplated that the high voltage power will be supplied to a nozzle 25, such as via buss bar 37 safely carried within a spacer 36, as appropriate. As will be explained, nozzle 25 includes a substantially continuous conductive shim (e.g., 112) along its length L, and only a single connection to the voltage source will be required. The high voltage power is supplied to each nozzle 25, such as via buss bar 37 and electrical connection 40 and a connector terminal 41 extending therethrough and contacting both the buss bar and the conductive shim (e.g. 112) within the nozzle (as will be described below).

Where it is desired to provide the high voltage line along substantially the entire longitudinal length L of a nozzle (e.g. where some discontinuity in the nozzle or the application pattern may be desired along length L), a high voltage pass-through (e.g., 39) might also be provided in other mounting blocks 24 located between end blocks 22. As illustrated in FIGS. 2 and 4, it is contemplated that housing 27 can be supportingly attached to mounting blocks 24, such as by nozzle mounting bolts 28 attached through mounting bores (e.g. 87, 106) in the front and rear members of housing 27 and into mounting bore 26.

A mounting plate (e.g., 44) is preferably provided to electrically isolate end blocks 22, mounting block 24, and the balance of upper nozzle assembly 20, from other support and operating structure mounted thereabove. For example, a flowable material header or plenum (e.g. 127) and air pressure header or plenum (e.g. 128) preferably utilized to control the supply of flowable material to individual chambers of a nozzle may be provided on a support beam or the like (not shown) to which nozzle assembly 20 is attached. One or more mounting plates 44 will preferably be provided above end blocks 22 and mounting blocks 24, respectively, of an insulative material (e.g., acetal plastic, such as available from DuPont under the name Delrin) to minimize the chances of the high voltage finding a path to ground along these structures.

A pair of inductor bars 42 are illustrated as being spaced in substantially parallel relationship from the dispensing edge (e.g. edge 29 defined by mating edges 73 and 93 as shown in FIG. 4) of each nozzle 25. It has been found that one or more inductor bars (e.g., 42) spaced from the dispensing edge of an electrostatic nozzle can be placed so as to help direct or guide the electrostatically dispensed material in a desired direction.

Figure 3:
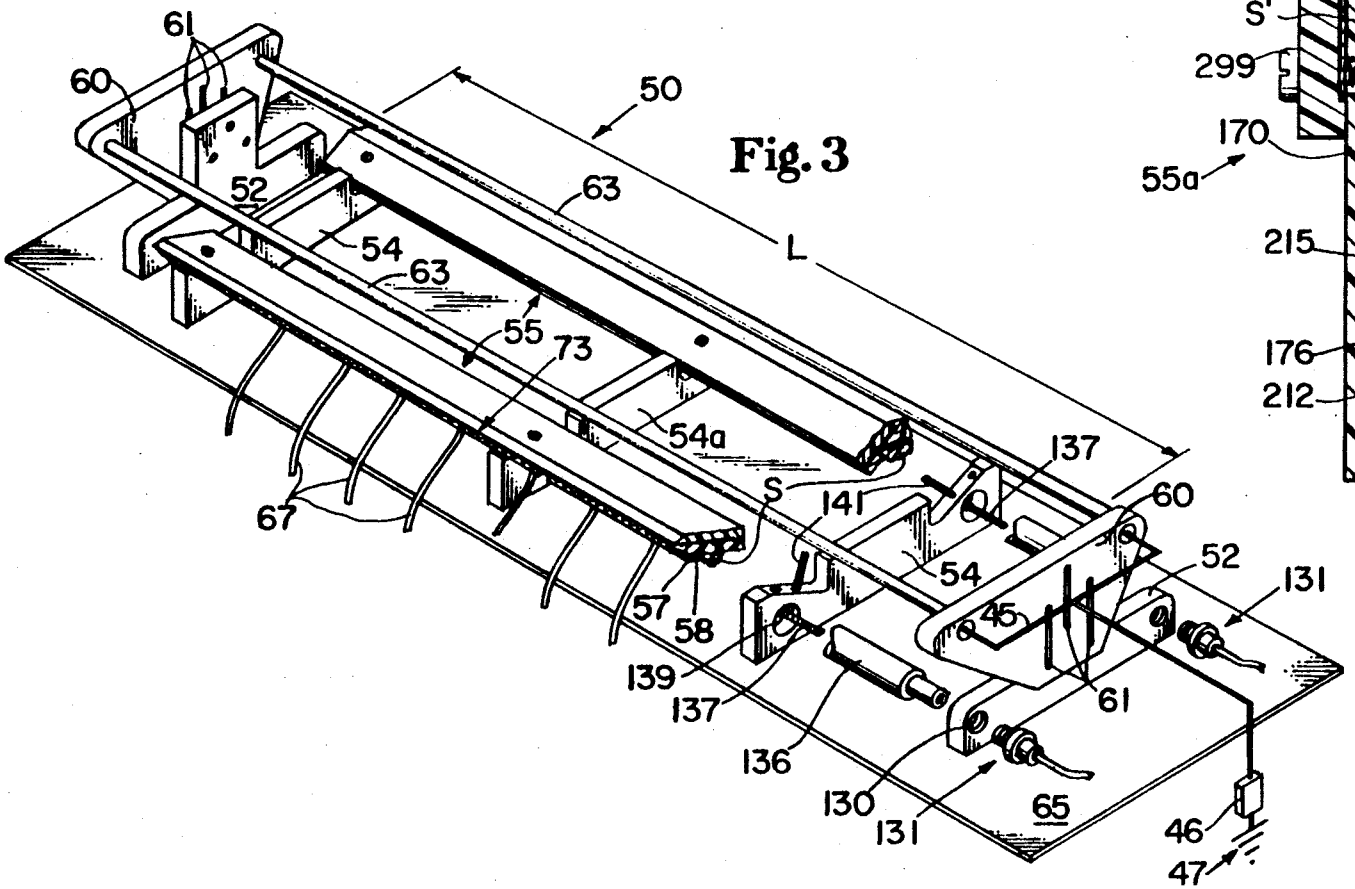
FIG. 3 is a partially broken out perspective view of another portion of a nozzle assembly made in accordance with the present invention, illustrating a pair of spaced nozzles oriented for generally upward dispensing.

Turning now to FIG. 3, a lower nozzle assembly 50 is illustrated as including a pair of spaced end blocks 52 and a corresponding pair of mounting blocks 54 having support recesses 59 designed to receive and support a pair of zoned unitary nozzles 55 in a predetermined upwardly oriented manner. Nozzles 55 are substantively identical to nozzles 25 shown in FIG. 2, with the exception that an intensifier arrangement is provided on nozzles 55, comprising an intensifier shim patch 57 holding an intensifier shim 58 closely adjacent dispensing edge 73. Particularly, it has been found that such an intensifier arrangement serves to boost the electrostatic field necessary to charge the flowable liquid sufficiently to adequately direct force charged particles upwardly from adjacent dispensing edge 73 against the force of gravity. As will be understood, electrode shim 58 of this intensifier is preferably electrically connected to the shim within nozzle 55, such as by a coil spring (illustrated schematically in FIG. 3 as spring S) or similar connector located therebetween.

End blocks 52 are also illustrated as receiving an adjustable inductor bar mount 60 which includes a plurality of adjustment slits 61 to enable vertical adjustment of the spacing of inductor bars 63 from respective nozzles 55. Because the electrostatically dispensed material will already be acting against the force of gravity as it is propelled in an upward direction, oftentimes it is preferred that only a single inductor bar 63 be provided for each upwardly disposed nozzle 55. If an inductor bar 63 is positioned above and slightly inwardly from the dispensing edge (e.g., 73) of a nozzle 55, the charged droplets dispensed will be attracted toward the bar somewhat. This attraction will generally not be sufficient for the material to actually hit the bar, but will serve to facilitate direction of the spray upwardly onto a target.

In use such inductor bars may tend to pick up some of the high voltage charge from the nozzle, and it has been found that optimum performance of multiple nozzles which are arranged to discharge upwardly in relatively closely spaced adjacent position is best obtained when a balance of charges on the inductor bars is maintained. Stability between bottom nozzle inductor bars 63 can be maintained such as by application of a continuity strip 45 between the ends of bars 63. It is also preferred to connect the inductor bars to ground (e.g., 47) through a resistor 46 of appropriate size (e.g., 100 mega ohms for voltages of about 50 to 75 kV).

An alternative procedure for stabilizing the charge on adjacent inductor bars of the present invention would be to provide a predetermined electrical charge to each of the bars, as appropriate. It has been found that by utilizing a continuity arrangement of this type, a plurality of upwardly directed electrostatic nozzle assemblies made in accordance herewith can be relatively closely spaced without significant deterioration in the performance of each nozzle. It has been observed that interference from adjacent nozzles and inductor bars is much less prevalent with downwardly directed nozzles, and, therefore, no such stabilization is generally required.

A lower nozzle assembly mounting plate 65 is provided in similar fashion to mounting plate 44 described with respect to upper nozzle assembly 20. Individual chambers within nozzles 55 are placed in fluid communication with a flowable material source, such as via individual material supply lines 67. High voltage power is also provided to nozzles 55 via feed-through assemblies 131, spacers 136, buss bars 137, and terminals 141, as discussed above. The spacing at the right end of FIG. 3 has been exaggerated to show details of the high voltage power supply. Generally, the right-most mounting block 54 would be located close to end block 52. A supplemental mounting block **54*a* is also shown in FIG. 3**, as might be desired for additional support in applications where longer longitudinal lengths L of nozzles are utilized.

FIG. 4 is a partial, exploded view of a nozzle assembly made in accordance with the present invention, such as illustrated as nozzle 25 in FIG. 2. Particularly, it is preferred that each nozzle assembly of the present invention comprise one or more substantially unitary nozzles having a dispensing edge (e.g., 73 and 93) of a predetermined longitudinal length L. Each such nozzle includes a front member or nozzle cap 70 having a distal edge 71 and an inner surface 74. A plurality of individual adjacent distribution chambers 76 are preferably recessed into the inner surface 74 of front member 70, having a predetermined depth d and expanding longitudinally in cross-sectional area from adjacent an inlet area 78 toward a longitudinal slot 77 along dispensing edge 73. It has been found that the flared or delta shape of the individual distribution chamber 76 helps to distribute and maintain a predetermined desired pressure of flowable material most conducive to uniform dispensing.

Front member 70 further includes connection holes 85 to facilitate alignment and connection with nozzle base or rear member 90, and mounting bores 87 to facilitate attachment to support structure (e.g. mounting block 24). One or more terminal channels 89 are also provided for facilitating electrical connection to the source of high voltage (e.g. via terminal pin 41).

The individual distribution chambers 76 are defined and effectively separated by a chamber isolator arrangement 80, preferably comprising a compressible sealing member 81 at least partially held within a substantially continuous sealing groove 83. Sealing member 81 might preferably be provided of a substantially impervious o-ring type material having an appropriate durometer to provide a reliable seal between front and rear members 70 and 90, as well as shim 112 arranged therebetween. Additionally, a barrier 84 is preferably provided on opposite lower ends of each chamber 76 to obviate significant migration of flowable material between adjacent distribution chambers. Particularly, it is contemplated that barrier 84 will extend downwardly from the lower peak of sealing member 81 and partially into slot 77. In this way, each distribution chamber 76 will be effectively substantially hydraulically independent of each of the other chambers and each nozzle will have a plurality of substantially identifiable zones along its length L.

Because each chamber of the present nozzle will preferably be provided with independent means (e.g., supply lines 123 and 67 shown in FIGS. 2 and 3, respectively) with a source of flowable material, the dispensing width (e.g., W) of a particular nozzle made in accordance herewith can be selectively varied as desired by controlling the flow of material to the individual chambers. As will be appreciated, front member 70 will be oriented with its inner surface 74 toward inner surface 94 of rear member 90, and with conductive shim 112 sandwiched therebetween.

In a preferred arrangement, shim 112 will comprise one or more shim plates 113 having a plurality of holes to accommodate the structure of the cap and base portions of a nozzle upon connection therewithin. For example, a plurality of hydraulic flow-through openings 115 will be provided to enable relatively unencumbered movement of flowable material within the individual chambers (e.g. 76 and 96) of the nozzle, while holes 117 accommodate connections between the front and rear housing members. While the shim of a particular nozzle may be provided as a unitary, or even one-piece, structure, it may be preferred for manufacturing ease to provide the shim as a series of electrically connected individual pieces, as illustrated in FIG. 4. To provide continuity between adjacent parts of shim 112, jumper pieces (e.g., 120) might preferably be provided, which may be located within jumper recesses 110 of the housing (e.g. within nozzle base 90).

Shim 112 is also illustrated as having a plurality of finger-like projections 116 designed to generally distribute and concentrate the charge adjacent to the dispensing edge (e.g., 73/93) of the nozzle. It should also be noted that a pair of ends 118 are provided as part of shim 112 without the discontinuous lower edge or fingers 116. Particularly, it has been found that in order to further control the distribution and flow of material electrostatically dispensed from a nozzle of this invention, it is important to provide an electrical field slightly beyond the longitudinal ends of the distribution width (e.g., W) desired. For example, if a particular distribution width W is desired along the length L of a nozzle, it is important to provide a pair of field gates 111 extending slightly beyond that width. The field gates insure that flowable material is electrostatically dispensed at the opposite longitudinal ends in a predictable and controlled manner, and minimizes the potential of charged material being deposited on objects outside of the target area (which results in overspray and/or lack of uniformity within the targeted area).

By providing field gate portions 111, wherein there is no fluid communication with the source of flowable material but there is an electrical charge provided, material dispensed from the active chambers along the width W remains more behaved and uniform. Similarly, to reduce the distribution width of the nozzle, additional effective field gates can be provided simply by terminating the supply of flowable material to particular chambers within the nozzle. For example, the distribution width (W) could be reduced (e.g., to width $W_1$) by terminating flow of material to the distributions chambers indicated at "A" and "B". In this way, a unitary nozzle made in accordance herewith can be quickly and automatically adjusted in application width without cumbersome changes of equipment or structure, and without sacrificing performance or time. Likewise, discontinuous dispensing across the width of a nozzle could be provided by selective control of individual distribution chambers or zones of chambers along length L. In such case, chambers wherein material supply was not provided would function as intermediate field gates as described above. Such adjustments could literally be accomplished in use and "on the fly" by control of the supply lines (e.g., via supply valves or solenoids 124 or the like).

Rear member 90 is substantively identical to the structure of front member 70, except that it may optionally include a serrated edge 98 formed along its dispensing edge 93 below the recessed distribution chambers 96. Serrated edges 98 can be preferred to generally determine the origination points of material flow lines from the nozzle during electrostatic distribution. However, it has been found that such serrations are not always necessary, and do not necessarily control the distribution pattern of particular materials at particular dispensing field strengths. For this reason, in many applications, nozzle dispensing edges may function best without such serrations.

As illustrated in FIG. 4, front member 70 is flipped downwardly onto the inner surface 94 of rear member 90 such that their distal edges (71 and 91), recessed distribution chambers (76 and 96), and dispensing edges (73 and 93) correspond for connection. In addition to the chamber isolator arrangement (e.g., 100, with sealing member 102, sealing groove 103, and barrier 104), mounting bores (106) and connection holes (86), as described above with regard to front member 70, rear member 90 further includes a plurality of hydraulic inlet ports 108 for connecting independent means (e.g., supply lines 67 and 123) for providing fluid communication between each such chamber and a source of the flowable material.

For example, supply lines 123, as illustrated in FIG. 2, would be individually connected via connectors 122 to an inlet port 108, such as by threaded sealing engagement. In a preferred arrangement, the supply of flowable material would be further controlled by a pneumatically or hydraulically operated valve 124 or similar device, whereby flowable material under low pressure (e.g., 5 psi) would be contained within plenum 127, and valve 124 would be Opened or closed by air pressure from plenum 128 (via line 125) as necessary or desired to control of material to the nozzle chamber. This arrangement further enables automatic purging of the system by replacing the material within plenum 127 with different material and/or cleaner from time to time.

Figure 5:
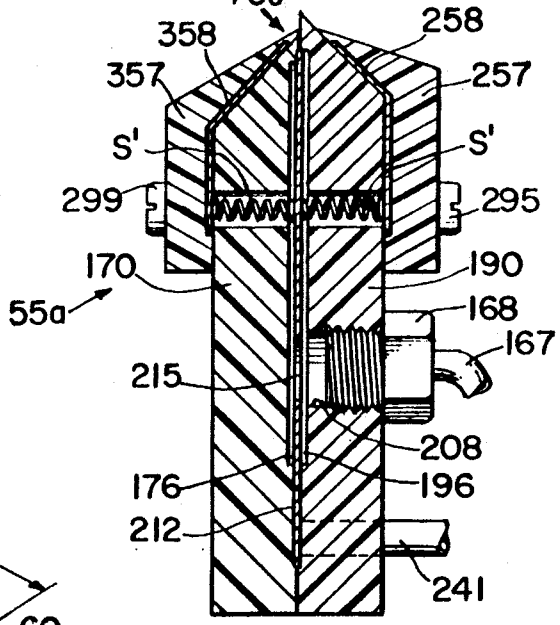
FIG. 5 is a vertical cross-sectional view of another preferred embodiment of a nozzle configuration of the present invention, wherein a pair of auxiliary field intensifiers are provided adjacent the dispensing edge to facilitate upward dispensing.

As mentioned above, in applications where material is to be directed upwardly against the force of gravity, it is preferred to augment the electrostatic field adjacent the nozzle dispensing edge. FIG. 5 illustrates an alternate preferred embodiment of a nozzle of the present invention for use in dispensing upwardly, and possible substantially vertically upwardly. Nozzle 55*a* is substantively identical to the nozzles 55 of FIG. 3, except that it includes a pair of intensifiers disposed on opposite longitudinal sides of dispensing edge 73*a* and shim 212.

Like the intensifier of FIG. 3, the lower intensifier of nozzle 55*a* comprises a shim patch 257 and auxiliary intensifier shim 258. Similarly, a second intensifier is provided via an intensifier shim 358 held in place by shim patch 357. The intensifier shims 258 and 358 are electrically connected to shim 212 via one or more conductors, (e.g., a pair of conductive $S^1$ springs), as mentioned above. One or more mounting screws, bolts or the like (e.g., connectors 295/299) might preferably mount patches 257 and 357 to the nozzle.

FIG. 5 also illustrates the supply line 167 and connector 168 which place a particular distribution chamber (e.g., the chamber defined by recesses 176 and 196 of nozzle cap 170 and base 190, respectively) in fluid communication with a source of material via inlet port 208.

Figure 6:
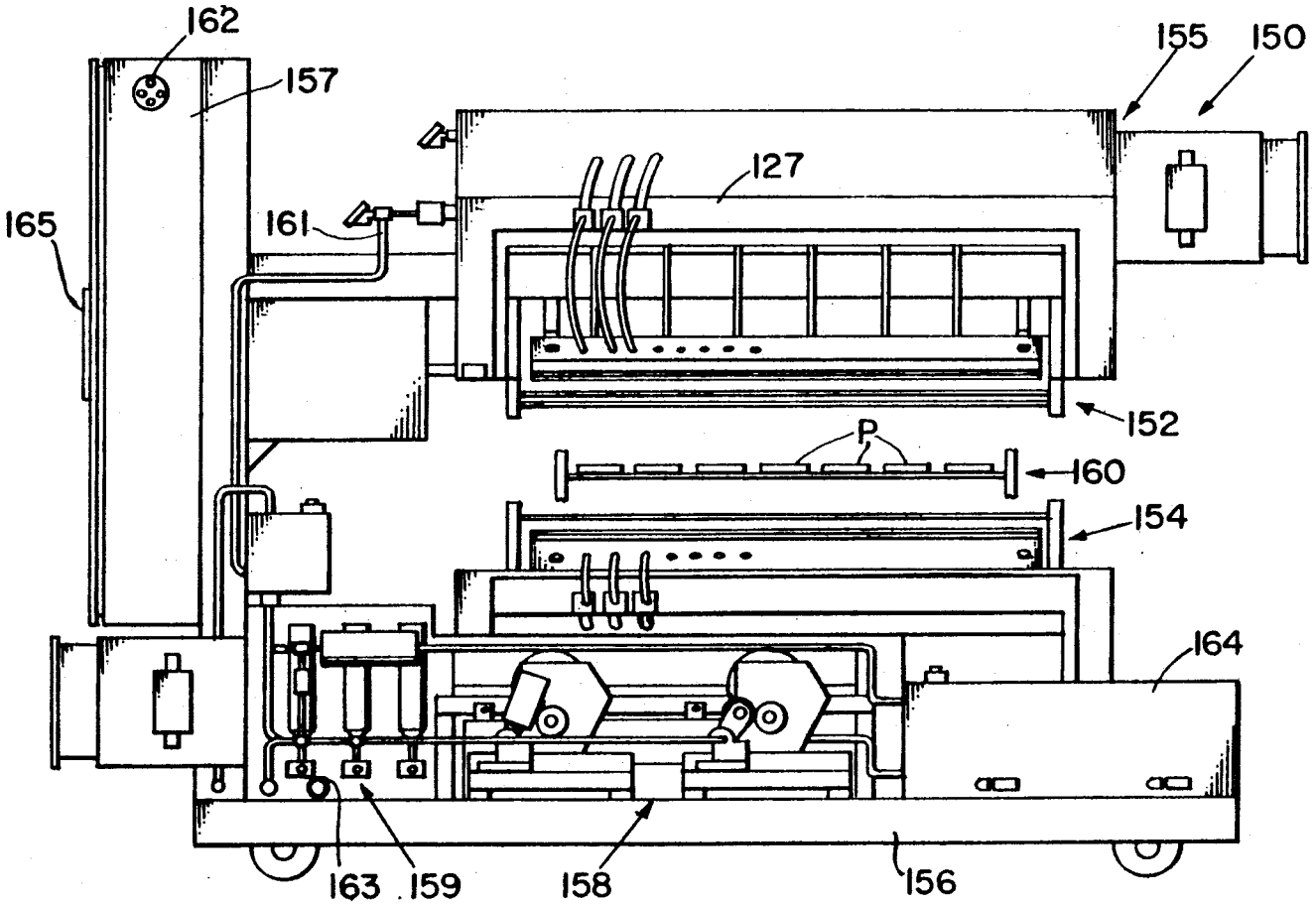
FIG. 6 is an elevational, partially schematic, view of a nozzle assembly made in accordance with the present invention and featuring nozzles for dispensing both upwardly and downwardly onto a target.

Turning now to FIG. 6, a nozzle assembly 150 made in accordance with the present invention is illustrated as including both an upper nozzle assembly 152 (similar to upper nozzle assembly 20 described above) and lower nozzle assembly 154 (similar to assembly 50 described above). Because many of the flowable materials to be electrostatically dispensed must be maintained at a particular (and often elevated) temperature for proper dispensing, an insulated canopy 155 might preferably be provided with heating and/or cooling means (not shown) for supporting nozzle assembly 152 as well as the material supply plenum 127.

Similarly, lower nozzle assembly 154 might also preferably be supported within an insulated unit which can be heated and/or cooled as desired. The entire nozzle assembly 150 might preferably be supported on a transportable frame 156, and enclosure 157 would preferably house a high voltage power supply and include a control panel 165 to facilitate monitoring of the process.

FIG. 6 further illustrates, schematically, pumping equipment 158, pressure transducers 159, and a flowable material storage sump 164 as examples of further parts of a preferred nozzle assembly of the present invention. A header supply line 161, high voltage power input 162, and pneumatic pressure input 163 are further illustrated as examples of convenient arrangements for operation of nozzle assembly 150 to dispense flowable material onto a target product (P), which can be moved along a product pass line or conveyor 160.

It has been found that controllable, uniform and consistent electrostatic dispensing can be provided from one or more nozzles arranged in the upper nozzle assembly of the present invention utilizing voltages of between about 40 and 50 kilovolts (slightly higher if a highly conductive flowable material is utilized) at about 200 microamps. As mentioned, the pressure provided to the flowable material is relatively low (about 5 psi) as the material need only be provided to the nozzle with enough pressure to ensure that the nozzle remains properly filled with fluid as dispensing continues. As will also be appreciated, pressures within the nozzle can be increased to facilitate purging and/or cleaning procedures as necessary or desired. Similarly, it has been found that superior dispensing can be provided in an upward direction from a nozzle arranged in the lower nozzle assembly (e.g., 154) of the present invention utilizing power in the range of 65 kilovolts or more, again at relatively low amperage (e.g., 200 microamps), and boosted by an intensifier arrangement as discussed herein.

Having shown and described the preferred embodiments of the present invention, further adaptions of the electrostatic dispensing arrangement and nozzle assembly described herein can be accomplished by appropriate modifications by one of ordinary skill in the art without departing from the scope of the present invention. Several of such potential modifications have been mentioned, and others will be apparent to those skilled in the art. For example, a plurality of nozzles made in accordance with the present invention could be stacked substantially one after the other to provide a series of successive dispensing nozzles for applications requiring particular deposition rates. Similarly, either the upper or lower nozzle assemblies could be utilized alone with one or more nozzles to accommodate a particular application requirement. The configuration, volume, or internal shape of the nozzle chambers could also be modified in various ways without departing from the intentions of this invention.

Accordingly, the scope of the present invention should be considered in terms of the following claims, and is understood not to be limited to the details of structure and operation shown and described in the specification and drawings.

We claim:

1. A nozzle assembly for electrostatically dispensing a flowable material onto a predetermined target in a controllable and uniform manner, said assembly comprising:

a nozzle having a housing with a dispensing edge of a predetermined longitudinal length, and front and rear members joined together to provide a substantially continuous slot adjacent said dispensing edge;

a plurality of substantially hydraulically independent distribution chambers arranged serially along said longitudinal length of said housing, each of said chambers in fluid communication with said slot;

means for providing an electrical charge in said flowable material within said distribution chambers and adjacent to said slot to cause said material to be dispensed from said nozzle assembly in use; and means for independently attaching each chamber to a source of flowable material, wherein said material can be selectively supplied from a source of said flowable material to individual distribution chambers to control dispensing along said nozzle slot, as desired; and means for selectively supplying said flowable material to individual selected active chambers to control the dispensing width of said nozzle, as desired, and at relatively low pressure to maintain each selected chamber properly filled with flowable material for electrostatic dispensing.

2. The nozzle assembly of claim 1, wherein said dispensing edge is substantially continuous and uninterrupted along the entire longitudinal width of said slot.

3. The nozzle assembly of claim 1, wherein at least one of said front and rear members is a unitary piece.

4. The nozzle assembly of claim 3, wherein both of said front and rear members are provided as unitary pieces to provide a substantially uninterrupted dispensing edge along which said slot is located.

5. The nozzle assembly of claim 1, wherein said chambers are each provided with a material inlet port and a substantially delta shaped cross-sectional conformation, expanding in width from adjacent said inlet port toward said dispensing edge.

6. The nozzle assembly of claim 1, wherein adjacent chambers are substantially hydraulically isolated from one another by a seal between said front and rear members.

7. The nozzle assembly of claim 1, wherein said means for providing an electrical charge to said flowable material comprises a conductive shim located at least partially within said housing and spanning a plurality of said chambers.

8. The nozzle assembly of claim 1, wherein said means for independently placing each chamber in fluid communication with a source of flowable material comprises a separate inlet connection adjacent each chamber, whereby material can be selectively supplied to certain chambers to the substantial exclusion of non-selected chambers.

9. The nozzle assembly of claim 1, wherein at least one nozzle is oriented substantially vertically for upward electrostatic dispensing, and further comprising at least one electrostatic field intensifier located adjacent the opposite longitudinal outer sides of said dispensing edge of the slot of that nozzle and spaced from the distribution flow of said flowable material.

10. The nozzle assembly of claim 9, wherein said upwardly oriented nozzle comprises a pair of electrostatic field intensifiers adjacent said slot and spaced along opposite longitudinal sides thereof.

11. The nozzle assembly of claim 1, comprising a pair of nozzles and at least one inductor bar located in spaced, substantially parallel relationship to said dispensing edge of each nozzle to facilitate controlled electrostatic dispensing of said flowable material from said dispensing edge, and means for balancing the electrical charge in said bars.

12. A nozzle assembly for electrostatically dispensing a flowable material onto a predetermined target in a controllable and uniform manner, said assembly comprising:

a nozzle having a housing with a predetermined longitudinal length and a substantially continuous dispensing edge spanning a substantial portion of said longitudinal length, and front and rear members joined together to provide a substantially continuous longitudinal slot adjacent to said dispensing edge;

a plurality of substantially hydraulically independent distribution chambers arranged serially along said longitudinal length of said housing, each of said chambers being in fluid communication with said slot and comprising a material inlet port through which flowable material can be selectively supplied;

means located at least partially within each chamber for providing an electrical charge to said flowable material therewithin and adjacent to said slot to cause said material to be electrostatically dispensed from said nozzle assembly in use; and means for selectively supplying said flowable material to individual active chambers to control the dispensing width of said nozzle, as desired, and a relatively low pressure to maintain each active chamber properly filled with flowable material for electrostatic dispensing.

13. The nozzle assembly of claim 12, wherein said slot has a longitudinal length along said dispensing slot edge, and is substantially continuous and uninterrupted along said slot length.

14. The nozzle assembly of claim 13, wherein at least one of said front and rear members is provided as a unitary piece to provide a substantially uninterrupted dispensing edge along which said slot is located.

15. The nozzle assembly of claim 11, wherein said chambers are each provided with a substantially delta shaped cross-sectional conformation, expanding in width from adjacent an inlet port toward said dispensing edge.

16. The nozzle assembly of claim 11, wherein adjacent chambers are substantially hydraulically isolated from one another by a seal between said front and rear members.

17. The nozzle assembly of claim 11, wherein said means for providing an electrical charge to said flowable material comprises a conductive shin located at least partially within said housing and spanning a plurality of said chambers along a substantial portion of said longitudinal length.

18. The nozzle assembly of claim 12, comprising a pair of nozzles and at least one inductor bar located in spaced, substantially parallel relationship to said dispensing edges of each of said nozzles to facilitate controlled electrostatic dispensing of said flowable material from said dispensing edge, and means for balancing the electrical charge in said bars.

19. The nozzle assembly of claim 12, wherein at least one nozzle is oriented substantially vertically for upward electrostatic dispensing, and comprising at least one electrostatic field intensifier located adjacent the opposite longitudinal outer sides of said dispensing edge of the slot of that nozzle and spaced from the distribution flow of said flowable material.

20. The nozzle assembly of claim 19, wherein said upwardly oriented nozzle comprises a pair of electrostatic field intensifiers adjacent said slot and spaced along opposite longitudinal sides thereof.

21. A nozzle assembly for electrostatically dispensing a flowable material onto a predetermined target in a controllable and uniform manner, said assembly comprising:

a nozzle with a housing having a longitudinal length and a substantially continuous dispensing edge spanning substantially said entire longitudinal length, and front and rear members joined together to provide a substantially continuous slot adjacent to said dispensing edge;

a plurality of substantially hydraulically independent distribution chambers arranged serially along said longitudinal length of said housing, each of said chambers being in fluid communication with said slot and comprising an inlet port through which flowable material can be selectively supplied;

means located at least partially within each chamber for providing an electrical charge to flowable material therewithin and adjacent to said slot to cause said material to be electrostatically dispensed from said nozzle assembly in use; and a pair of spaced field gates, one field gate located at each of opposite ends of the longitudinal length of said housing, whereby an electrical charge is provided adjacent said dispensing edge, but no fluid communication with a source of said flowable material is provided.

22. The nozzle assembly of claim 21, wherein said means for providing an electrical charge to said flowable material comprises a conductive shim located at least partially within said housing and spanning across substantially all of said chambers and field gates along a substantial portion of said longitudinal length.

23. The nozzle assembly of claim 21 wherein said assembly is designed to electrostatically dispense flowable material in a direction having a component oriented against gravity, wherein said means for providing an electrical charge comprises a high voltage source of at least about 60 kilovolts.

24. The nozzle assembly of claim 21, wherein at least one of said front and rear members is provided as a unitary-piece.

25. The nozzle assembly of claim 21, comprising a pair of nozzles and at least one inductor bar located in spaced, substantially parallel relationship to said dispensing edges of each of said nozzles to facilitate controlled electrostatic dispensing of said flowable material from said dispensing edge, and means for balancing the electrical charge in said bars.

26. The nozzle assembly of claim 21, wherein at least one nozzle is oriented for upward electrostatic dispensing, and at least one electrostatic field intensifier is located adjacent said slot.

27. A nozzle assembly for electrostatically dispensing a flowable material onto a predetermined target in a controllable and uniform manner, said assembly comprising:

a nozzle having a housing with a dispensing edge of a predetermined longitudinal length, and front and rear members joined together to provide a substantially continuous slot adjacent said dispensing edge;

a plurality of substantially hydraulically independent distribution chambers arranged serially along said longitudinal length of said housing, each of said chambers in fluid communication with said slot;

means for providing an electrical charge to said flowable material within said distribution chambers and adjacent to said slot to cause said material to be dispensed from said nozzle assembly in use; and means for independently attaching each chamber to a source of flowable material, wherein said material can be selectively supplied from a source of said flowable material to individual distribution chambers to control dispensing along said nozzle slot as desired; and an integral field gate at each end of the longitudinal length of said housing wherein no fluid communication with a source of said flowable material is provided, but wherein means for providing electrical charge to flowable material is provided adjacent said dispensing edge.

28. A nozzle assembly for electrostatically dispensing a flowable material onto a predetermined target in a controllable and uniform manner, said assembly comprising:

a nozzle having a housing with a predetermined longitudinal length and a substantially continuous dispensing edge spanning a substantial portion of said longitudinal length, and front and rear members joined together to provide a substantially continuous longitudinal slot adjacent to said dispensing edge;

a plurality of substantially hydraulically independent distribution chambers arranged serially along said longitudinal length of said housing, each of said chambers being in fluid communication with said slot and comprising a material inlet port through which flowable material can be selectively supplied;

means located at least partially within each chamber for providing an electrical charge to said flowable material therewithin and adjacent to aid slot to cause said material to be electrostatically dispensed from said nozzle assembly in use; and an integral field gate at each of the opposite ends of the longitudinal length of said housing, wherein no fluid communication with a source of said flowable material is provided, but wherein means for providing electrical charge to flowable material is provided adjacent said dispensing edge.

29. The nozzle assembly of claim 1, further comprising one or more intermediate field gates along said longitudinal length, said intermediate field gates selectively provided in the form of chambers to which the supply of flowable material is not supplied by said means for selectively supplying said flowable material, whereby a controlled, uniform width and pattern of dispensing along said nozzle can be automatically implemented without a need for structural modifications.

30. The nozzle assembly of claim 12, further comprising one or more intermediate field gates along said longitudinal length, said intermediate field gates selectively provided in the form of chambers to which the supply of flowable material is not supplied by said means for selectively supplying said flowable material, whereby a controlled, uniform width and pattern of dispensing along said nozzle can be automatically implemented without a need for structural modifications.

31. The nozzle assembly of claim 21, further comprising one or more intermediate field gates along said longitudinal length, said intermediate field gates selectively provided in the form of chambers to which the supply of flowable material is not supplied by said means for selectively supplying said flowable material, whereby a controlled, uniform width and pattern of dispensing along said nozzle can be automatically implemented without a need for structural modifications.

* * * * *

UNITED STATES PATENT AND TRADEMARK OFFICE

CERTIFICATE OF CORRECTION

PATENT NO. : 5,209,410

DATED : May 11, 1993

INVENTOR(S) : Frederick R. Wichmann & Donald R. Henry

It is certified that error appears in the above—identified patent and that said Letters Patent is hereby corrected as shown below:

In column 12, claim 15, line 30, "claim 11" should read --claim 12--

In column 12, claim 16, line 35, "claim 11" should read --claim 12--

In column 12, claim 17, line 39, "claim 11" should read --claim 12--

In column 12, claim 17, line 41, "shin" should read --shim--

Signed and Sealed this

Eighth Day of March, 1994

Bruce Lehman

*Attest:*

BRUCE LEHMAN

*Attesting Officer*

*Commissioner of Patents and Trademarks*